United States Patent [19]

Farnhill

[11] 4,219,998

[45] Sep. 2, 1980

[54] APPARATUS FOR TWISTING A STRAND

[75] Inventor: William M. Farnhill, Burnley, England

[73] Assignee: Platt Saco Lowell Limited, Helmshore, England

[21] Appl. No.: 944,099

[22] Filed: Sep. 20, 1978

[30] Foreign Application Priority Data

Sep. 21, 1977 [GB] United Kingdom ..... 39245/77

[51] Int. Cl.[3] ..... D02G 3/26; D02G 3/28; D01H 5/28; D02G 1/04

[52] U.S. Cl. ..... 57/293; 57/328; 57/333; 57/350

[58] Field of Search ..... 57/293, 333, 350, 328, 57/294

[56] References Cited

U.S. PATENT DOCUMENTS

| | | | |
|---|---|---|---|
| 2,884,756 | 5/1959 | Head | 57/350 X |
| 3,490,219 | 1/1970 | Ozawa et al. | 57/333 X |
| 3,702,055 | 11/1972 | Kosaka et al. | 57/333 X |
| 3,742,692 | 7/1973 | Bense | 57/333 X |
| 4,055,039 | 10/1977 | Movshovich et al. | 57/333 X |
| 4,058,960 | 11/1977 | Movshovich et al. | 57/293 |
| 4,083,172 | 4/1978 | Norris et al. | 57/293 |
| 4,123,893 | 11/1978 | Chambley et al. | 57/293 X |
| 4,124,972 | 11/1978 | Arai et al. | 57/333 X |

FOREIGN PATENT DOCUMENTS

| | | |
|---|---|---|
| 863316 | 9/1958 | United Kingdom . |
| 867610 | 12/1958 | United Kingdom . |
| 1240016 | 9/1969 | United Kingdom . |
| 1471996 | 4/1977 | United Kingdom . |

*Primary Examiner*—John Petrakes

*Attorney, Agent, or Firm*—Donald H. Feldman

[57] ABSTRACT

An apparatus for twisting a fibre strand to have repeated along its length alternating zones of opposite twist comprises a fluid vortex device having two fluid inlets and a valve controlling fluid flow to the inlets. The valve comprises a hollow cylindrical rotatable valve member and a sleeve having a number of outlet ports surrounding the member. Fluid supplied to the hollow member is distributed to the outlet ports by rotation of the member. Plastics dry bearings between the member and the sleeve act to prevent improper flow of air along the abutting surfaces. The vortex device comprises a member formed with a bore, the bore having a wide port into which the fluid is injected through the inlets and a restricted port forming a venturi of diameter of the order twice that of the yarn. A plug through which the yarn passes at the end of the bore remote from the venturi inhibits escape of air from that end.

16 Claims, 9 Drawing Figures

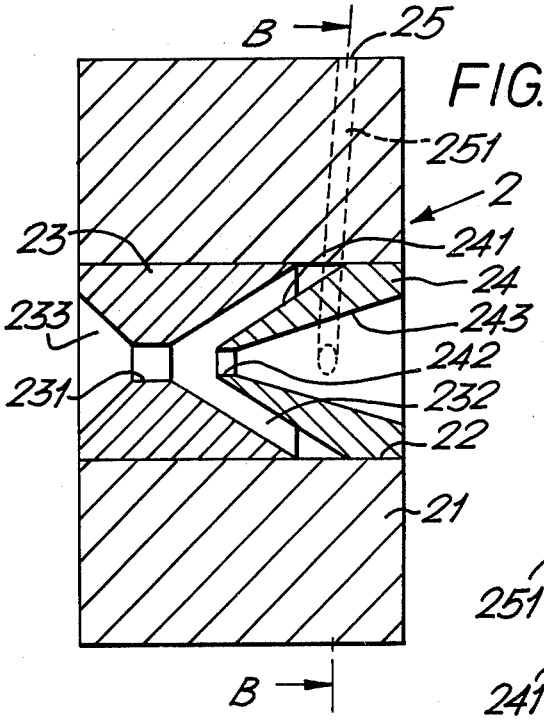
FIG.3.
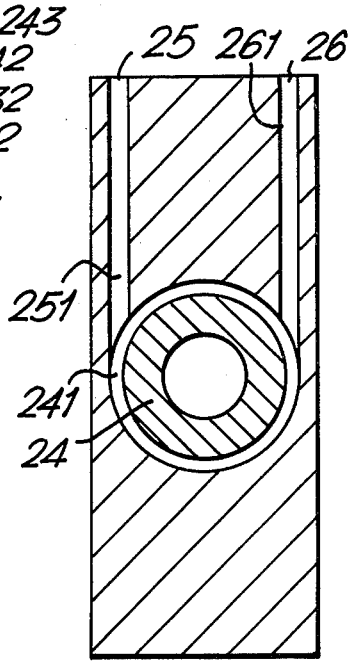
FIG.5.
FIG.4.
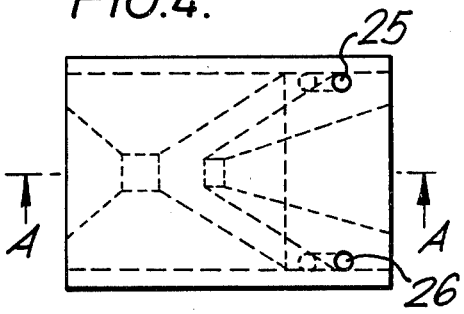

APPARATUS FOR TWISTING A STRAND

FIELD OF THE INVENTION

This invention relates to apparatus and method for twisting a fibre strand of the kind wherein the strand is twisted such that is has repeated along its length alternating zones of opposite twist.

In British Pat. No. 1,015,291 is disclosed a process for forming a stable twofold yarn structure from two strands by twisting one or both so that each or either has repeated along its length alternating zones of opposite twist, and allowing the strands to converge so that they may partially untwist about one another. This process is known as "self-twist" and forms a "self-twist" yarn.

The most problematic and limiting area of machines for carrying out this process has always been the particular twisting device itself used for twisting each strand with the alternating zones. The only fully commercial arrangement has used twisting rollers as shown in British Pat. No. 1,121,942 which reciprocate and rotate. However these have many limitations, not the least being the limitation of cycle length due to the limited length of roller which in practice can be used.

It has been proposed to use instead vortex twisting units employing rotating fluid vortices to twist the strands, but no practical embodiment has yet emerged.

DESCRIPTION OF THE PRIOR ART

Russian Pat. No. 475430 discloses an apparatus of this kind comprising a vortex device through which the strand in use is arranged to pass, a pair of fluid inlets for alternately directing fluid into the device to produce within the device vortices in opposite directions for twisting the strand passing therethrough and a valve for controlling the supply of fluid to the fluid inlets, the valve comprising a valve body having first and second fluid channels connected to respective ones of the pair of fluid inlets, a rotatable valve member mounted so that a surface thereof rotates relative to a co-operating surface of the body, and means for supplying fluid under pressure to the member, the surface of the member including a plurality of channels whereby fluid is supplied alternately to said first and second fluid channels.

The apparatus in this patent has disadvantages that the valve body only covers one half of the rotatable valve member and is biassed into contact therewith by a spring. Thus it is almost certain that air will escape from the intended channels and will migrate across the surface of the valve member to enter the incorrect fluid inlet to cause a vortex in opposition to the intended vortex. Pressure from the spring will undoubtedly also cause unacceptable wear on the surface of the valve member and valve body.

Additionally the vortex device disclosed comprises a simple tube which has been found not to make most efficient use of the expensive compressed air supply.

U.S. Pat. No. 4,058,960, by some of the same inventors as the above Russian patent, discloses an apparatus of the same type, wherein the valve body forms a sleeve surrounding the valve body. However a clearance is left between the surfaces to allow passage of some air at all times to both fluid inlets. The vortex device is substantially the same as in the above patent.

These patents have the disadvantage that they are inefficient in the use of compressed air to operate the vortex device, and efficacy of a device of this type is very dependent upon the amount of expensive compressed air employed.

It is one object of this invention to provide an improved apparatus of this type, particularly though not exclusively in the efficient usage of compressed air.

SUMMARY OF THE INVENTION

According to a first aspect the invention provides an apparatus for twisting a strand such that it has repeated along its length alternating zones of opposite twist, comprising a vortex device through which the strand in use is arranged to pass, a pair of fluid inlets for alternately directing fluid into the device to produce within the device vortices in opposite directions for twisting the strand passing therethrough and a valve for controlling the supply of fluid to the fluid inlets, the valve comprising a valve body having first and second fluid channels connected to respective ones of the pair of fluid inlets, a rotatable valve member mounted so that a surface thereof rotates relative to a co-operating surface of the body, and means for supplying fluid under pressure to the member, the surface of the member including a plurality of channels whereby fluid is supplied alternately to said first and second fluid channels, characterized in that plastics sealing means are provided at the point of contact between the surfaces to prevent undesired travel such as leakage of fluid along and between the surfaces.

According to a preferred embodiment, the pipes connecting the valve body outlets to the inlets of the vortex unit are kept short, for example less than 1 foot in length, and have no branches. Thus in an apparatus including two or more such vortex devices, each includes a respective one of two or more such valves. Alternatively a multiple valve may be provided with a plurality of fluid outlets, two for each vortex device. In such a multiple valve, the rotatable valve member may be formed of two or more parts which can be angularly relatively adjusted to alter the phase of the supply of fluid to respective vortex devices.

Preferably the present vortex device comprises a body having a bore through which the strand in use is arranged to pass, the bore having a first portion and a second portion of smaller cross-sectional area, means for alternately introducing a fluid at the first portion into the body in directions to induce alternate rotating fluid flows within the bore firstly in one direction then in the opposite direction, and means for causing the flows to move towards the second portion, whereby the alternating rotating fluid flows pass through the second portion to twist the strand passing therethrough.

Preferably the means for causing the flows to move comprises a first member through which the strand passes having a surface extending from the first portion towards the second portion. The surface of the member is preferably smooth to allow the rotating flows to pass freely thereover in both directions. Preferably the strand passes through the bore in a direction such that it passes firstly through the member and then through the second portion of the bore.

In a preferred arrangement the second portion is provided on a separate second member, whereby the first and second members can be inserted into the bore to enable ready interchanging of the second portion and yarn passages to accommodate differing counts of yarns.

In a further particularly preferred feature the fluid introducing means include orifices in the first portion and bores leading through the body arranged on opposite sides of the first portion such that the fluid is injected into the first portion at an angle to a line normal to the yarn travel direction towards the second portion so that fluid injected by one orifice is not disturbed by passing over the opposite orifice.

BRIEF DESCRIPTION OF THE DRAWINGS

FIG. 3 is a cross-section along the lines A—A of FIG. 4 through one of the vortex tubes of FIG. 1;

FIG. 4 is a plan view of the vortex tube of FIG. 3;

FIG. 5 is a cross-section along the lines B—B of FIG. 3;

DESCRIPTION OF THE PREFERRED EMBODIMENT

Figure 1:
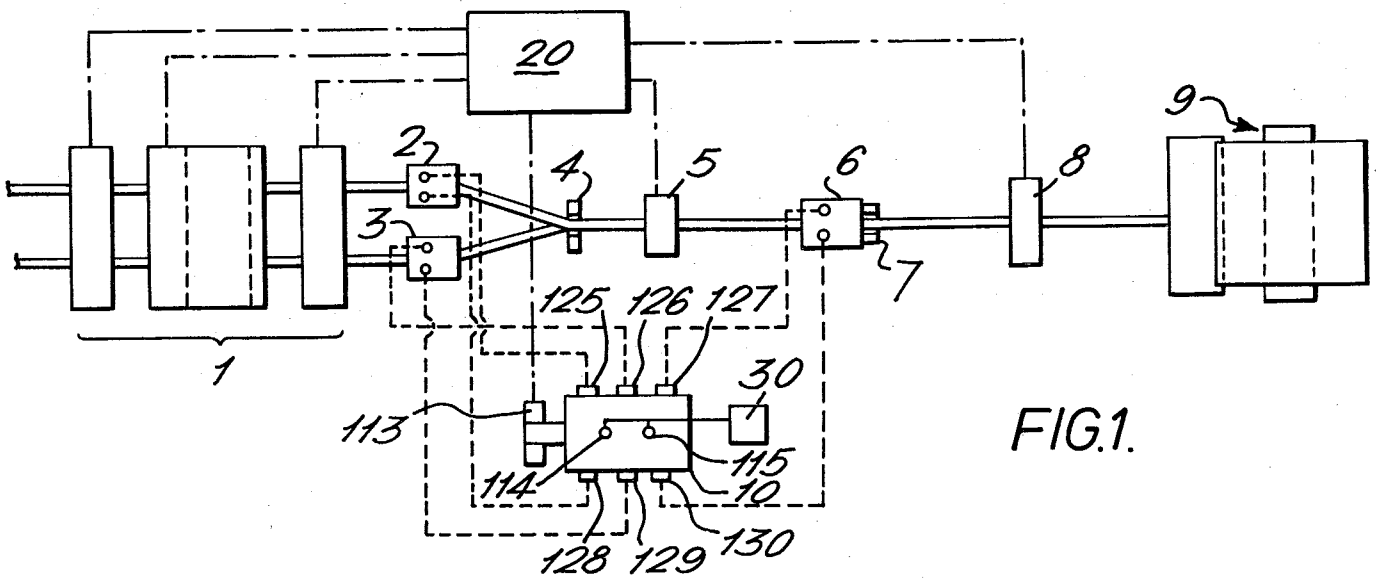
FIG. 1 shows a schematic plan view of an apparatus according to the invention for forming a self-twist yarn.
Figure 2:
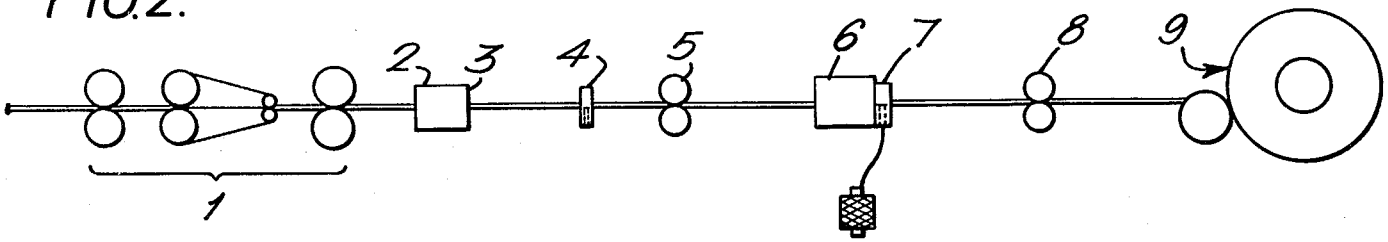
FIG. 2 is a side view of the apparatus of FIG. 1.

Referring firstly to FIGS. 1 and 2 an apparatus for forming a self-twist yarn comprises a drafting system, generally designated 1 by bracket, to which two strands are fed from a creel not shown. The drafting system 1 is of a conventional kind for example an apron drafting system.

Downstream of the front drafting rollers unnumbered of the drafting system 1 is a pair of vortex twisting units 2, 3 one of which is shown in FIGS. 3, 4 and 5 and will be described in greater detail hereinafter. A convergence guide 4 assembles the two strands which received alternating S and Z twist in the units 2 and 3 to form a self twist yarn. This process is well known and is becoming a conventional technique but for a fuller explanation reference should be made to British Pat. No. 1,015,291. The vortex units 2, 3 are separated by a distance sufficient to avoid entangling of the strands when the tension is reduced at twist change over points. In practice 2.5 cms. to 5 cms. separation has been found to suffice.

A pair of nip rollers 5 is positioned downstream of the convergence guide 4 for isolating the formation of the self-twist yarn at the convergence guide from the further processes downstream of the nip rollers.

A further vortex twisting unit 6 receives the self-twisted yarn from the nip rollers 5 and is of the same form as the units 2 and 3 thus introducing into the already self-twisted yarn further alternating zones of S and Z twist. A further guide 7 controls the introduction of a monofilament onto the alternately twisted self-twist structure to wrap the filament around the structure. The guide 7 is positioned immediately following the twisting unit 6 and is in the form of a "V" with a hole through the base at apex of the "V" so as to introduce the monofilament through the hole immediately onto the twisted strands. This process is additionally known and is fully described in British Pat. No. 1,144,614, to which reference may be made if desired.

A further pair of nip rollers 8 separates the formation of the yarn at the twisting unit 6 and guide 7 from a wind-up unit shown schematically at 9, where the yarn is wound into a suitable package.

A main drive motor 20 (shown only schematically) serves to drive the drafting system 1 the nip rollers 5, 6, the package take-up 9 and a valve 10 (described in detail hereinafter).

Turning now to FIGS. 3, 4 and 5 there is shown one vortex twisting unit 2 which is the same as the units 3 and 6. The unit 2 comprises a rectangular block 21 with a bore 22 of constant diameter formed therethrough extending from one face of the block to the opposite face. Within the bore is fitted a first cylindrical member 23 of substantially the same diameter so that it can readily be slipped into the bore and secured by a grub screw so that its end face coincides with the first end face of the block 21. The member 23 has a smaller diameter bore 231, coaxial with the bore 22, therethrough and countersunk on each surface to form a first frusto conical surface 232 semiangle 30° on one side leading from the outermost edge of the member 23 to the bore 231, and a second frusto conical surface 233 of semi-angle 45° on the opposite side, the second surface terminating on the face of the member 23 spaced from the edge. Thus the member 23 forms a "venturi" such that air passing through the member is constricted by the first surface 232 to pass through the bore 231 and then is allowed to expand under control of the surface 233.

A second part cylindrical member 24 of substantially the same diameter as the bore 22 is slidably fitted within the bore so that it can suitably be secured by a grub screw (not shown) such that its end face coincides with the second end face of the block 21.

The member 24 has a first outer frustoconical surface 241 extending from its outer cylindrical surface towards the axis terminating at an inner bore 242 extending coaxially through the member. The surface 241 has the same semi-angle as the surface 232, which is 30°, and extends partly into the counterbore formed by the surface 232 so as to form an annular tapering channel with parallel sides. A counterbore 243 within the member 24 coaxial with the bore 242 forms a further frustoconical surface tapering at a small semi-angle from the end face of the member 24 to the bore 242.

The member 24 thus forms a plug substantially sealing the end of the bore 22 opposite the venturi 23.

A pair of air inlets shown in FIGS. 4 and 5 at 25, 26 are provided at the top of the unit 2 and communicate with respective bores 251, 261 within the block 21 leading to the bore 22 and breaking out on the surface of the bore 22 substantially at opposite sides as shown particularly in FIG. 5. The inlets 25 and 26 are connected to a valve 10 shown schematically in FIG. 1 and in greater detail in FIGS. 8 and 9. As will be explained in greater detail hereinafter, the valve 10 acts to control the supply of air from a pressure source 30 alternately to the inlets 25 and 26. In this way, when the pressure source is connected to the inlet 25, air is injected through the wall of the bore 22 substantially tangentially to the bore and at an axial position adjacent the outermost portion of the surface 241. The air stream is thus caused to whirl within the bore 22. The bores 251 and 261 are angled at 10° from the vertical towards the venturi 23 such that the air injected by the bore 251 as it travels around the surface of the bore 22 misses the opening of the bore 261 to avoid disturbing the smooth air flow. The confining channel formed by the surfaces 241 and 232 causes the air stream to move axially and radially inwardly toward the venturi 23 thus increasing in velocity to form a vortex as it passes through the venturi.

Each of the vortex twisting units 2, 3 and 6 is arranged such that the respective strand passes through the unit in a direction such that it enters the plug 24 firstly and then passes through the venturi 23.

The motion of the strand thus tends to assist the motion of the air towards the venturi 23 and to inhibit air escaping from the unit through the plug 24.

The diameter of the bore 231 of the venturi 23 is chosen such that the cross-sectional area of the bore is of the order of twice the cross-sectional area of the strand passing therethrough. In this way an air annulus around the strand has the same cross-sectional area as the strand itself. The diameter of the bore 242 of the plug 24 is chosen such that it allows free passage of the yarn and free propogation of twist in the yarn through the bore while reducing to a minimum the escape of air counter to the yarn direction through the bore. The bore 242 is thus smaller than the bore 231.

Passage of the strand through the air vortex in the bore 231 thus applies a twisting force to the portion of the strand in the bore in an anti-clockwise direction as shown in FIG. 5.

Similarly and symmetrically, when the valve 10 causes the inlet 26 to be connected to the air pressure source, an air vortex is set up in the opposite direction to twist the strand in the clockwise direction.

Figure 7:
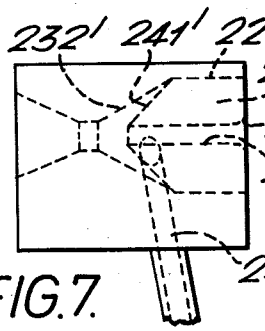
FIGS. 6 and 7 are views similar to those of FIGS. 3 and 4 showing an alternative form of vortex tube.
Figure 6:
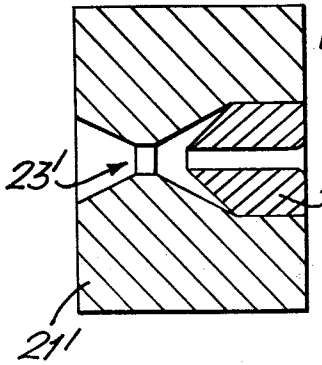

In the alternative embodiment of vortex twisting unit shown in FIGS. 6 and 7, only the differences from the embodiment of FIGS. 3, 4 and 5 will be described. Firstly, the vortex 23' is formed integrally with the block 21' instead of being formed as a separate portion. Secondly, the bore 242' of the plug 24' extends substantially through the plug at constant diameter to more effectively inhibit the passage of air through the plug 24'. A small flared portion 243' is provided as an aid to introducing the strand into the portion 24' for piecing purposes. Thirdly, the bores 251' and 261' (not shown) break out on the frusto-conical surface 232' rather than the cylindrical portion of the bore 22'. Fourthly, the plug 24' extends into the bore 22' until its front surface 241' abutts the surface 232' and the semi-angle of the surface 241' is 45° thus leaving a widening gap between the surfaces 232' and 241'.

Figure 9:
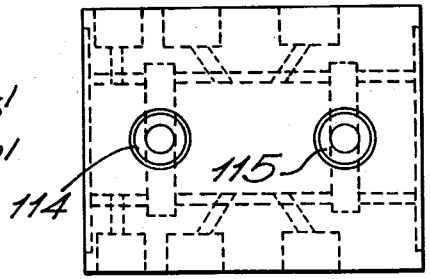
FIG. 9 is a plan view of the valve of FIG. 8 with the internal bores shown in dotted line.
Figure 8:
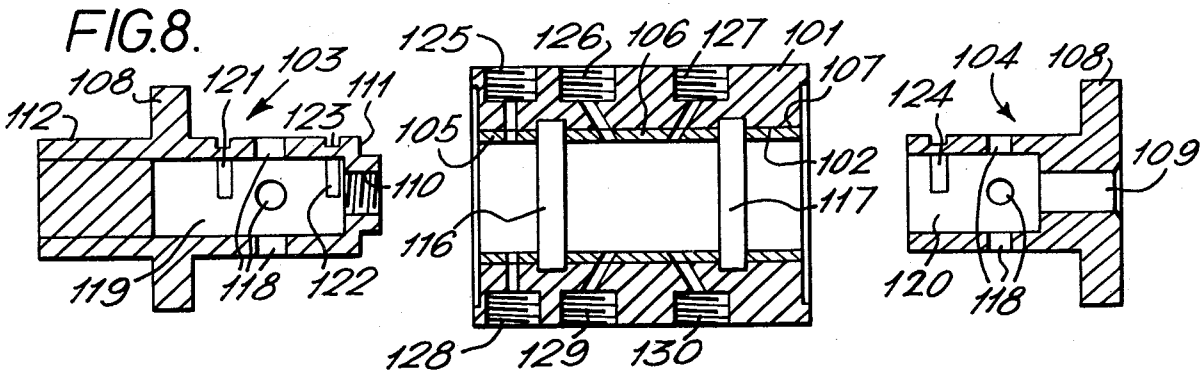
FIG. 8 is an exploded cross-section through the valve and valve member of FIG. 1.

Turning now to the details of the valve 10 shown in FIGS. 8 and 9 and the schematic view of FIG. 1, the valve comprises a valve body 101 with a bore 102 within which is rotatably mounted (in use, although shown exploded in FIG. 8) a valve member formed of two parts 103, 104. The valve body and valve member are formed of metal with dry bearings 105, 106 and 107 fitted in the valve body which remain fixed relative thereto, and which enable free rotation of the valve member within the body. The dry bearings each comprise plastics sleeves 105 supported by and secured to a metal cylinder which can be press fit into the bore 102. The plastics sleeve 105 generally of PTFE i.e., the polymer polytetrafluoroethylene, acts to form a bearing between the metal surfaces of the body and the member and additionally acts to prevent improper travel of air such as by leakage along the surface of the valve member. The parts 103 and 104 each include a flange 108 for axially locating the parts when firmly connected together by a bolt (not shown) which passes through a bore 109 in the part 104 and engages a screw threaded bore 110 in the part 103 so as to draw a shoulder 111 of the part 103 against the end of the part 104. By slackening and retighting the bolt, the relative angular positions of the parts 103 and 104 can be adjusted as explained in more detail hereinafter.

The part 103 includes a stub shaft 112 for connection to a drive wheel 113 (shown in FIG. 1) connected to the main drive motor 20 of the machine via a variable gear box (not shown). In this way the valve member 103, 104 can be rotated in synchronism with machine speed and at a preselectable rate relative thereto.

The valve body 101 includes a first pair of ports 114, 115 (FIGS. 1 and 9) which are connected to a source of high pressure air (shown schematically at 30) via intervening valves (not shown) for controlling the air pressure at the ports 114, 115. Each of the ports 114, 115 is connected via a short bore to respective one of two annular cavities 116, 117 formed in the body 101 and surrounding the valve member 103, 104 at spaced axial locations along its length. The bearing members 105, 106 and 107 do not extend into the cavities to allow free communication of the air at the ports 114, 115 to the surface of the member 103, 104.

At the axial locations of the parts 103 and 104 corresponding to the cavities 116, 117 each of the parts includes four bores 118 leading to a respective hollow interior 119, 120 of the parts 103 and 104. Thus the air supply at the port 114 is communicated to the interior 119 of the part 103 and the air supply at the port 115 is communicated to the interior 120 of the part 104, and the interiors 119, 120 are separated by the bolt (not shown) co-operating with the thread 110.

The part 103 additionally includes a pair of radial slots 121 and 122 extending over 180° of the periphery at spaced axial locations on either side of the bores 118. The slots 121 and 122 communicate with the interior 119 apart from at a small supporting central portion 123 extending only over a part of the thickness of the wall of the part 103 to prevent bending of the part 103. Similarly the part 104 includes a radial slot 124 exactly the same as the slots 121 and 122.

The body 101, as shown in FIG. 8, includes six further ports 125 to 130 arranged in diametrically opposed pairs with each pair being located at an axial position to co-operate with a respective one of the slots 121, 122, 123. Each port communicates with its respective short bore extending through the thickness of the valve body and through the respective bearing member so as to communicate with the surface of valve member at the axial location of the respective slot. The bearing member prevents improper travel of air along the surface of the valve body and thus ensures that air is supplied only to the intended port and not additionally to the opposite port to act against the desired direction of vortex.

Each pair of ports is associated with a respective one of the vortex twisting units 2, 3 and 6 such that (as shown in FIG. 1) the ports 125, 128 are connected by pipes (shown only schematically) respectively to the inlets 25, 26 of the vortex unit 2, the ports 126, 129 are connected to the inlets 25, 26 of the vortex unit 3 and the ports 127, 130 are connected to the inlets 25, 26 of the vortex unit 6. The piping from each port to each respective inlet is kept as short as possible, for example less than 1 foot, to ensure a rapid build up and decay of the vortex at switching. Additionally it is extremely important that the pipes to each vortex unit are equal in length to ensure equal twisting in opposite directions. Furthermore each valve port is directly connected by a single separate pipe to its respective vortex unit inlet to avoid any branches in the pipes.

In operation, the main motor 20 drives the drafting system 1 to produce two drafted strands which are fed to the vortex units 2 and 3. The main motor also drives the valve member 103, 104 at a rate synchronous with the main drive which can be selected to produce one rotation for a particular length of strands produced or cycle length.

As the valve member rotates, air supplied from the port 114 to the interior of the part 103 is communicated alternately, firstly to the ports 125, 126 and then to the ports 128, 129 in phase and for 180° of rotation of the valve member or one half cycle. Slightly more or slightly less than 180° may be possible in practice, but it is most important to keep untwisted zones to a minimum. In one arrangement the slots 121, 122 may be designed so as to gradually open communication to the respective port shortly before the opposite port is closed so as to commence movement of the air stream whereby when the opposite port is closed the air stream is fully developed. Air supplied to the ports 125, 126 is communicated to the inlets 25 of the units 2 and 3 to set up a vortex, as explained before, in one direction to twist the strand supplied thereto in that direction for one half cycle. Subsequently air supplied to the ports 128, 129 is communicated to the inlets 26 to twist the strands in the opposite direction. In practice a cycle length of the order of 60 cms. is preferred although as low as 14 cm. and as high as 120 cm. have been used.

The twisted strands are converged at the guide 4 to form a self-twist strand structure of a cycle length equal to the cycle length selected by the rate of rotation of the valve member 103, 104.

The self-twist structure is subsequently supplied to the vortex unit 6 similarly to the vortex units 2 and 3 this is fed with air by the ports 127, 130 at the same cycle length as the units 2 and 3 but at a phase difference chosen by varying the angle between the parts 103 and 104, which can vary between 0° and 360°. The vortex unit 6 serves to wrap the filament around the self-twist structure to form a yarn and for the best advantage the filament is wrapped in such a way that the zero twist position of the strands does not coincide with the zero twist position of the filament.

The formed two-fold yarn is then packaged for subsequent use.

The machine can also be used to produce other constructions of yarn as disclosed in the aforementioned British Pat. No. 1,144,614. For example, a single strand can be fed from the drafting system and passed through the vortex unit 2. A first filament is then wrapped around the strand at the guide 4 and a second filament wrapped at the second guide 7 to form a single yarn wrapped twice at different phases with two filaments. Additionally a threefold yarn can be formed using an additional vortex unit adjacent the units 2 and 3.

Alternatively, the vortex twisting units and valves could be used in a machine for producing a yarn which is twisted only once, as shown in the aforementioned British Pat. No. 1,015,291.

In a further arrangement of the machine, each vortex twisting unit may include its own valve arrangement of a simplified form to ensure very short connecting pipes of equal length and without any branches.

I claim:

1. Apparatus for twisting a strand such that it has repeated along its length alternating zones of opposite twist, said apparatus comprising a vortex device formed with a pair of fluid inlets for alternately directly fluid into said device to produce within said device vortices in opposite directions for twisting said strand passing therethrough and having a body portion formed with a bore through which said strand in use is arranged to pass, said bore being formed with a first portion of one cross-sectional area and a second portion of another and smaller cross-sectional area which latter is of the order of twice the cross-sectional area of said strand in use arranged to pass therethrough, a valve for controlling a supply of said fluid to said fluid inlets, said valve comprising a valve body being formed with first and second fluid channels communicating with respective ones of said pair of fluid inlets, and a rotatable valve member mounted so that a surface thereof rotates relative to a cooperating surface of said valve body, said cooperating surface of said valve member being formed with a plurality of channels whereby fluid may be supplied alternately to said first and second channels of said valve body, means for supplying said fluid under pressure to said rotatable valve member, and plastics sealing means at the points of contact between said cooperating surfaces for preventing improper travel of fluid along said surfaces.

2. Apparatus as claimed in claim 1, wherein said sealing means comprises at least one separate plastics portion carried by one of said valve body and said valve member.

3. Apparatus as claimed in claim 2, wherein said sealing means is formed with openings therethrough coincident with the channels of the port by which it is carried.

4. Apparatus as claimed in claim 1, wherein said cooperating surface of the valve body fully covers said surface of said valve member.

5. Apparatus as claimed in claim 1, wherein the surface of said valve member is the circumferential surface of a cylinder and said valve body comprises a sleeve surrounding said cylinder.

6. Apparatus as claimed in claim 5, wherein said cylinder is substantially hollow and said fluid supply means is arranged to supply fluid to the hollow interior thereof.

7. Apparatus as claimed in claim 1, wherein said sealing means acts as a bearing between said valve body and said valve member.

8. Apparatus as claimed in claim 1, wherein said vortex device further comprises directing means for causing flows of fluid to move toward said second portion of said bore whereby the majority of each of the alternating rotating flows of fluid passes through said second portion of said bore thereby to twist said strand passing therethrough.

9. Apparatus for twisting a strand such that it has repeated along its length alternating zones of opposite twist, comprising a body portion formed with a bore through which the strand in use is arranged to pass, said bore having a first portion of one cross-sectional area and a second portion of another and smaller cross-sectional area which is of the order of twice that of said strand, fluid providing means for alternately introducing a fluid at said first bore portion into said body portion in directions to induce alternate rotating fluid flows within said bore firstly in one direction and then in the opposite direction, wherein directing means are provided for causing said fluid flows to move toward said second bore portion whereby the majority of each of the alternating rotating flows passes through said second bore portion to twist the strand passing therethrough.

10. Apparatus as claimed in claim 8 or 9, wherein the walls of said bore taper conically from said first bore portion to said second bore portion.

11. Apparatus as claimed in claim 8 or 9, wherein said directing means comprises a first member through which said strand passes having a surface extending from said first bore portion toward said second bore portion.

12. Apparatus as claimed in claim 11, wherein said first member of said directing means is formed with a bore therethrough through which the yarn in use may pass, which latter bore is of smaller diameter than said second bore portion of said body portion and larger than the diameter of said yarn.

13. Apparatus as claimed in claim 11, wherein said directing means includes a second member which second member is formed with said second bore portion and wherein said first and second members can be inserted into said first bore portion to enable ready interchange of said members to accommodate differing counts of yarn.

14. Apparatus as claimed in claim 11, wherein said surface of said first member is smooth whereby the rotating flows may pass freely thereover in both directions.

15. Apparatus as claimed in claim 8 or 9, wherein said body portion is arranged such that in use the strand may pass sequentially through said first bore portion and then through said second bore portion.

16. Apparatus as claimed in claim 8 or 9, wherein said fluid providing means is formed with orifices at said first bore portion and with bores which extend through said body portion to said orifices entering at opposite sides of said first bore portion such that said fluid may enter into said first bore portion at an angle to a line normal to the yarn travel direction towards said second bore portion, so that said fluid flow entering by one orifice is not disturbed by passing over an opposite orifice.

* * * * *